US012085334B2

(12) United States Patent
Peyron et al.

(10) Patent No.: US 12,085,334 B2
(45) Date of Patent: Sep. 10, 2024

(54) METHOD FOR LIQUEFYING NATURAL GAS WITH IMPROVED INJECTION OF A MIXED REFRIGERANT STREAM

(71) Applicant: L'Air Liquide, Société Anonyme pour l'Etude et l'Exploitation des Procédés Georges Claude, Paris (FR)

(72) Inventors: Jean-Marc Peyron, Creteil (FR); Sophie Lazzarini, Saint Mande (FR); Sébastien Lichtle, Paris (FR); Thomas Morel, Champs-sur-Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 277 days.

(21) Appl. No.: 17/632,112

(22) PCT Filed: Jul. 20, 2020

(86) PCT No.: PCT/FR2020/051309
§ 371 (c)(1),
(2) Date: Feb. 1, 2022

(87) PCT Pub. No.: WO2021/019149
PCT Pub. Date: Feb. 4, 2021

(65) Prior Publication Data

US 2022/0316795 A1 Oct. 6, 2022

(30) Foreign Application Priority Data

Aug. 1, 2019 (FR) ..... 1908841

(51) Int. Cl.
*F25J 1/02* (2006.01)
*F25J 1/00* (2006.01)

(52) U.S. Cl.
CPC ..... *F25J 1/0022* (2013.01); *F25J 1/0055* (2013.01); *F25J 1/0092* (2013.01); *F25J 1/0214* (2013.01);
(Continued)

(58) Field of Classification Search
CPC ..... F25J 1/0022; F25J 1/005; F25J 1/0244; F25J 1/0255; F25J 1/0252; F25J 2280/02; F25J 2280/50
See application file for complete search history.

(56) References Cited

U.S. PATENT DOCUMENTS 3,992,168 A 11/1976 Toyama et al.
4,181,174 A 1/1980 Grenier
(Continued)

FOREIGN PATENT DOCUMENTS

EP 1 088 578 4/2001
EP 3 015 807 5/2016
(Continued)

OTHER PUBLICATIONS

Fischer, B., A new process to reduce LNG cost, ICHE Spring Meeting, Natural Gas Utilization Conference, X, US, Mar. 10, 2002, 191-202.
(Continued)

*Primary Examiner* — Brian M King
(74) *Attorney, Agent, or Firm* — Elwood L. Haynes

(57) ABSTRACT

A method for liquefying a stream of hydrocarbons from a feed stream, including introducing the feed stream and a first cooling stream into a first heat exchanger, extracting a plurality of partial cooling streams obtained from the first cooling stream from the heat exchanger via separate outlets, introducing each partial cooling stream into an expansion element to produce a plurality of biphasic cooling streams at different pressures, introducing each biphasic cooling stream
(Continued)

into a phase separator element to produce a gaseous cooling stream which is diverted from the first exchanger and a liquid cooling stream which is introduced into the first exchanger via respective inlets, evaporating each liquid cooling stream by heat exchange with at least the feed stream and the first cooling stream so as to extract a cooled hydrocarbon stream at the outlet from the first heat exchanger and to extract a plurality of evaporated cooling streams.

11 Claims, 2 Drawing Sheets

(52) U.S. Cl.
CPC ..... *F25J 1/0262* (2013.01); *F25J 1/0292* (2013.01); *F25J 2290/32* (2013.01)

(56) References Cited

U.S. PATENT DOCUMENTS

| | | | | |
|---|---|---|---|---|
| 4,330,308 | A | 5/1982 | Grenier et al. | |
| 4,646,822 | A | 3/1987 | Voggenreiter et al. | |
| 5,199,266 | A | 4/1993 | Johansen | |
| 2007/0227185 | A1 | 10/2007 | Stone et al. | |
| 2012/0067079 | A1 | 3/2012 | Sethna et al. | |
| 2015/0260451 | A1 | 9/2015 | Haberberge et al. | |
| 2017/0131026 | A1* | 5/2017 | Imamkhan | F25J 1/0292 |
| 2017/0292783 | A1* | 10/2017 | Chen | F25J 1/0072 |
| 2018/0299210 | A1 | 10/2018 | Ronacher | |
| 2018/0356150 | A1 | 12/2018 | Chambron | |
| 2020/0041179 | A1* | 2/2020 | Ducote, Jr. | F25J 1/0212 |
| 2021/0164734 | A1 | 6/2021 | Haik-Beraud et al. | |

FOREIGN PATENT DOCUMENTS

| | | |
|---|---|---|
| FR | 2 563 620 | 10/1985 |
| FR | 1 857 133 | 2/2020 |
| WO | WO 2014 087225 | 6/2014 |
| WO | WO 2017 081374 | 5/2017 |
| WO | WO 2017 134353 | 8/2017 |
| WO | WO 2018 172644 | 9/2018 |

OTHER PUBLICATIONS

Onaka, M. et al., Use of plate fin heat exchangers for main cryogenic exchanger units, LNG Journal, Nelton Publications, Gravesend, GB, Jan. 1, 1997, 17-19.

Paradowski, H. et al., Experimental study of plate heat exchangers condensing and vaporizing liquefied hydrocarbon gases, GPA Technical Meeting, Feb. 1, 2001, 1-14.

Stone, J. B. et al., LNG process selection considerations for future developments, International Conference and Exhibition of Liquefied Natural Gas (LNG), Apr. 18, 2010, Oran, Algeria, vol. 16, Poster PO1-13, 1-9.

International Search Report for corresponding PCT/FR2020/051309, Oct. 30, 2020.

* cited by examiner

METHOD FOR LIQUEFYING NATURAL GAS WITH IMPROVED INJECTION OF A MIXED REFRIGERANT STREAM

CROSS REFERENCE TO RELATED APPLICATIONS

This application is a 371 of International Application No. PCT/FR2020/051309, filed Jul. 20, 2020, which claims priority to French Patent Application No. 1908841, filed Aug. 1, 2019, the entire contents of which are incorporated herein by reference.

BACKGROUND

The present invention concerns a method for liquefying a stream of hydrocarbons, such as natural gas, said method employing at least one cooling stream which evaporates in a heat exchanger against the hydrocarbon stream to be liquefied.

It is desirable to liquefy natural gas for a certain number of reasons. By way of example, natural gas can be stored and transported over long distances more easily in the liquid state than in the gaseous state, since it occupies a smaller volume for a given mass and does not need to be stored at a high pressure.

There are a number of techniques for liquefying a stream of natural gas to obtain liquefied natural gas (LNG). Typically, a cooling stream, generally a mixed cooling stream formed of a mixture containing hydrocarbons, is compressed by a compressor and then introduced into a heat exchanger, where it is liquefied and subcooled to the coldest temperature in the process, typically that of the stream of liquefied natural gas. At the coldest outlet from the exchanger, the cooling stream is expanded, forming a liquid phase and a gaseous phase. These two phases are remixed and reintroduced into the exchanger. The cooling stream introduced into the exchanger in a biphasic state is evaporated therein against the hydrocarbon stream, which undergoes liquefaction. Document WO-A-2017081374 describes one of these known techniques.

Also known is a liquefaction method employing two cooling cycles. The first cooling cycle allows the natural gas to be cooled to its bubble point using two or more levels of expansion of a first cooling mixture that operate at different pressures, to increase the efficiency of the cycle. The second cycle allows the natural gas to be liquefied and subcooled and employs only one level of expansion of a second cooling mixture. Each expansion level affords a biphasic fluid, which is reintroduced into the exchanger in the liquid-gas mixture state and is evaporated by heat exchange with the stream of natural gas, which undergoes cooling and liquefaction.

One technology commonly used for exchangers for liquefying natural gas is that of aluminum exchangers with plates and fins that are brazed. These exchangers comprise plates between which are inserted heat-exchange corrugations, formed of a succession of fins or corrugation legs, thus constituting a stack of evaporation passages and condensation passages, some of which may be intended to evaporate the refrigerant liquid and the others to condense a heat-generating gas.

These exchangers enable very compact devices offering a large heat-exchange surface to be obtained, and enable operation with small temperature differences and with reduced head losses, thereby enhancing the energy performance of the liquefaction method described above.

There are, nevertheless, certain problems with the known liquefaction techniques, particularly because of the biphasic nature of the mixed cooling streams reintroduced into the exchangers.

Indeed, in order to ensure correct operation of an exchanger employing a biphasic cooling mixture, the proportion of liquid phase and of gas phase needs to be the same in all of the passages and needs to be uniform within one and the same passage.

The dimensions of the exchanger are calculated on the assumption of a uniform distribution of the phases, and therefore of a single temperature at the end of vaporization of the liquid phase, equal to the dew point of the mixture. In the case of a multi-constituent mixture, the temperature at the end of evaporation is dependent on the proportion of liquid phase and of gas phase in the passages.

In the event of an unequal distribution of the two phases in the mixture, the temperature profile of the first fluid will then vary from passage to passage, or even vary within one and the same passage. Because of this nonuniform distribution, there is then a possibility that the fluid or fluids in an exchange relationship with the two-phase mixture may have a temperature at the exchanger outlet that is higher than envisaged, and this diminishes the performance of the heat exchanger.

One solution for distributing the liquid and gas phases of the mixture more uniformly is to introduce them into the exchanger separately, then mix them together only once they are inside the exchanger. FR-A-2563620 or WO-A-2018172644 discloses devices for performing biphasic introduction into an exchanger. These devices are machined components comprising a specific arrangement of separate channels for a liquid phase and a gaseous phase and of orifices enabling fluid communication between these channels to distribute a liquid-gas mixture.

These devices, though, are complicated to design in terms of sizing and under certain conditions may not operate across the entire service range of the method. There may also be imbalances in the fluid feed of the various orifices, resulting in unequal distribution of the liquid-gas mixture in the width of the exchanger passage. Moreover, at fairly low gas flow rates generated by the expansions, corresponding typically to gas/liquid ratios of 3 to 4% (mol %), the devices for biphasic introduction may pointlessly complicate the architecture of the battery of exchangers. Another problem arising concerns the risks of incomplete evaporation of the biphasic cooling mixture. Indeed, the cooling fluid exiting the exchanger is sent to a compressor and then condensed before being reintroduced into the exchanger, thereby closing the cooling cycle. If the cooling fluid is not completely evaporated on exiting the exchanger, it is possible for liquid droplets to be sent to the compressor, posing a risk of damage to the high-speed moving elements of said compressor.

Furthermore, document US-A-2007227185 teaches separation of the liquid and gaseous phases of the cooling mixture and introduction of the liquid phase into the exchanger, whereas the gaseous phase is diverted from the exchanger. In that case the same risks arise of incomplete evaporation of the liquid cooling mixture.

SUMMARY

It is an aim of the present invention to solve all or part of the problems referred to above, especially by proposing a method for liquefying a stream of hydrocarbons against at least one cooling stream, wherein the distribution of said cooling stream in the exchanger is extremely uniform and at the same time the architecture of the liquefaction plant is simplified and the integrity of its constituent apparatuses is preserved.

The solution according to the invention is thus a method for liquefying a stream of hydrocarbons such as natural gas from a feed stream, said method comprising the following steps:

a) introducing the feed stream into a first heat exchanger, b) introducing a first cooling stream into the heat exchanger, c) extracting a plurality of partial cooling streams obtained from the first cooling stream from the heat exchanger via separate outlets, d) introducing each partial cooling stream from step c) into an expansion element and expanding each partial cooling stream to produce a plurality of biphasic cooling streams at different pressures, e) introducing each biphasic cooling stream from step d) into a phase separator element to produce a gaseous cooling stream which is diverted from the first exchanger and a liquid cooling stream which is introduced into the first exchanger via respective inlets, f) evaporating each liquid cooling stream by heat exchange with at least the feed stream and the first cooling stream so as to extract a cooled hydrocarbon stream at the outlet from the first heat exchanger and to extract a plurality of evaporated cooling streams via the respective outlets of the first heat exchanger, characterized in that it further comprises, for each of the evaporated cooling streams from step f), the following steps:

g) measuring the temperature of the evaporated cooling stream at its respective outlet, h) determining the dew point of the evaporated cooling stream, i) determining a first temperature difference corresponding to the difference between the temperature measured in step g) and the dew point measured in step h), j) adjusting a setpoint flow rate applied to the expansion element as a function of the first temperature difference determined in step i) so as to reduce the flow rate of partial cooling stream expanded in step d) when the first temperature difference is less than a first predetermined value and to increase the flow rate of partial cooling stream expanded in step d) when the first temperature difference is greater than said first predetermined value.

As appropriate, the invention may comprise one or more of the following features:

the first predetermined value is not less than 5° C., preferably less than 15° C., more preferably between 8 and 12° C.

for each of the evaporated cooling streams, the setpoint flow rate is applied via a flow rate control element coupled to the expansion element and governed by the first temperature difference determined in step i).

prior to step j), the flow rate of partial cooling stream has a setpoint value and, in step j), the flow rate of partial cooling stream is reduced or increased by 5 to 20%, preferably by 10 and 20% relative to the setpoint value.

steps g) to j) are reiterated at a period of between 100 milliseconds and 1 second, preferably of between 200 and 500 milliseconds.

the feed stream is introduced via a first inlet sited at a hot end of the first exchanger, said first inlet having the highest temperature of the exchanger, and at least one of the liquid cooling streams is introduced via a respective inlet sited at a cold end of the first exchanger, said respective inlet having the lowest temperature of the exchanger, the liquid cooling streams being evaporated in the first exchanger in an ascending direction and in the direction of the hot end.

The method further comprises the following steps:

k) measuring the temperatures at which the feed stream (110) and the first cooling stream (30) are introduced into the first exchanger (E1), l) measuring the temperature of at least one evaporated cooling stream at its respective outlet (14, 15, 16), m) determining a second temperature difference corresponding to the difference between the temperature at which the feed stream (110) is introduced and the temperature of the evaporated cooling stream, and a third temperature difference corresponding to the difference between the temperature at which the first cooling stream (30) is introduced and the temperature of the evaporated cooling stream, n) adjusting the setpoint flow rate applied to at least one expansion element (V1, V2, V3) as a function of the second temperature difference and of the third temperature difference determined in step m) so as to reduce the flow rate of partial cooling stream expanded in step d) when the second temperature difference is greater than a second predetermined value or the third temperature difference is greater than a third predetermined value.

the second predetermined value and/or the third predetermined value is not greater than 10° C., preferably between 1 and 5° C., more preferably between 1 and 3° C.

in step d), at least a first biphasic cooling stream having a first pressure and a second biphasic cooling stream having a second pressure are produced, the first pressure being greater than the second pressure, giving rise respectively to a first evaporated cooling stream exiting the first exchanger via a first respective outlet and to a second evaporated cooling stream exiting the first exchanger via a second respective outlet, the first outlet being closest to the hot end of the first exchanger and the temperature measurement in step 1) being carried out solely on the first evaporated stream exiting via the first respective outlet.

each gaseous cooling stream and each evaporated cooling stream obtained from a respective phase separator element are recombined at the recombination point and then introduced into a pressure-increasing element such as a compressor.

each gaseous cooling stream is introduced into a supplementary separator element disposed between the recombination point and the phase separator element.

the biphasic cooling streams produced in step d) each have a gas/liquid ratio of less than 10%, preferably of between 2 and 5% (mol %), said ratio being defined as the relation between the molar flow rate of liquid phase and the molar flow rate of gaseous phase in each biphasic cooling stream.

the first cooling stream comprises a mixture of hydrocarbons containing a plurality of constituents selected from methane, ethane, nitrogen, propane, butane, pentane, ethylene and propylene.

the first cooling stream comprises between 40 and 90% of ethane and/or ethylene and between 10 and 60% of propane and/or propylene (mol %).

the method further comprises the following steps:

i) introducing the cooled hydrocarbon stream exiting the first heat exchanger into a second heat exchanger, ii) introducing a second cooling stream into the second heat exchanger, said second cooling stream having preferably circulated previously in the first heat exchanger, iii) causing the second cooling stream introduced in step b) to exit and expanding said second cooling stream such as to produce a second biphasic cooling stream (203), iv) reintroducing the second biphasic cooling stream (203) from step iii) into the second heat exchanger, and v) liquefying the cooled hydrocarbon stream by heat exchange with at least the second biphasic cooling stream reintroduced in step iv) so as to obtain an at least partially liquefied hydrocarbon stream.

The expression "natural gas" relates to any composition containing hydrocarbons, at least including methane. This embraces a "crude" composition (prior to any treatment or scrubbing) and also any composition which has been partially, substantially or completely treated for the reduction and/or removal of one or more compounds, including, but without being limited to, sulfur, carbon dioxide, water, mercury and certain heavy and aromatic hydrocarbons.

BRIEF DESCRIPTION OF THE DRAWINGS

The present invention will now be better understood by virtue of the following description, which is provided solely by way of nonlimiting example and with reference to the accompanying drawings, in which.

DETAILED DESCRIPTION OF PREFERRED EMBODIMENTS

Figure 1:
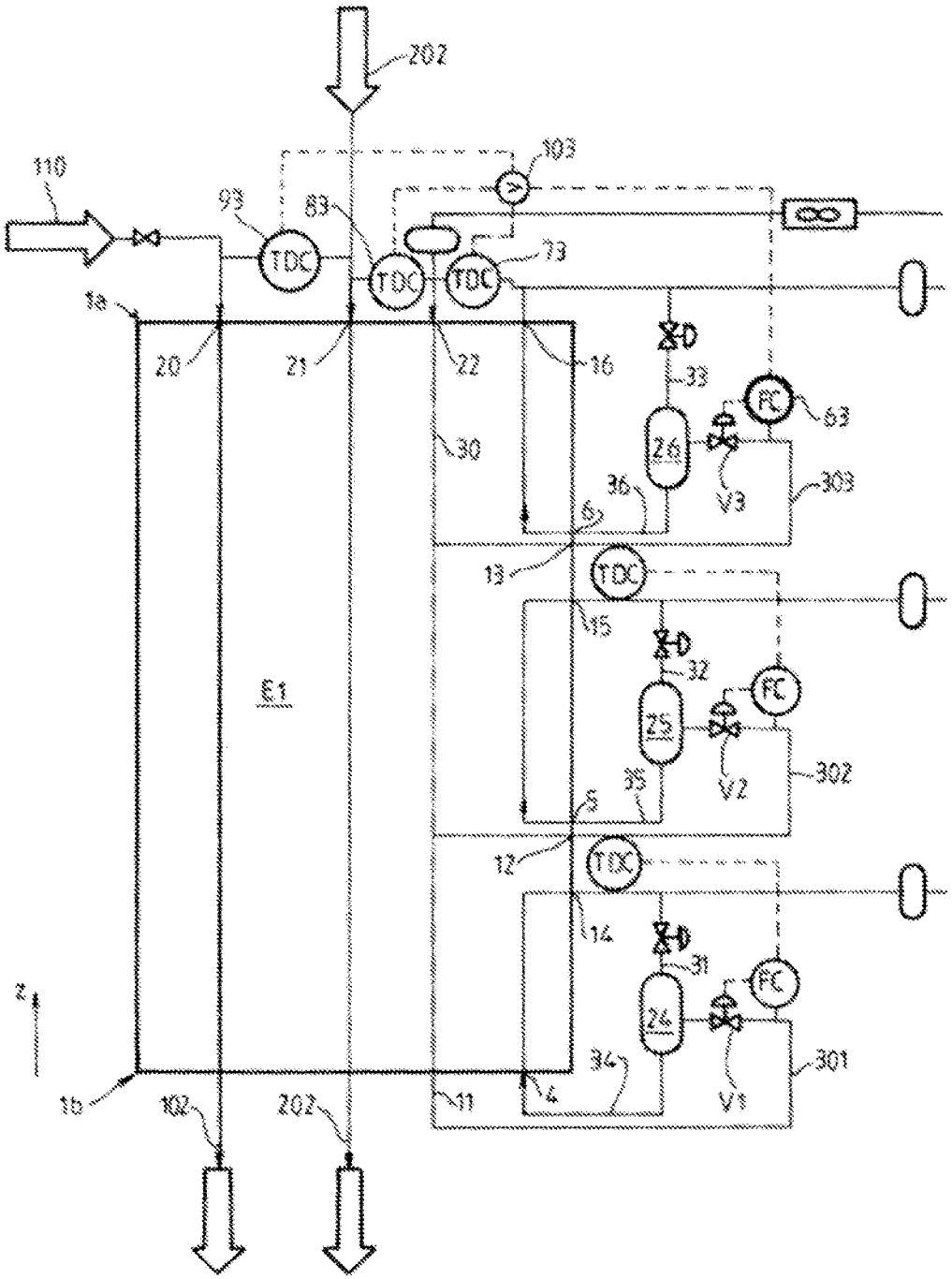
FIG. 1 schematically shows a method for liquefying a hydrocarbon stream according to one embodiment of the invention.

FIG. 1 schematically shows a method for liquefying a hydrocarbon stream such as natural gas, comprising a cooling cycle in which the natural gas is cooled to its dew point using three different levels of expansion to increase the efficiency of the cycle.

Note that within the invention at least two levels of expansion may be employed.

This cooling cycle is operated using a first cooling stream 30 introduced into a first heat exchanger E1.

The exchanger E1 may be any device comprising passages suitable for the flow of two or more fluids and permitting direct or indirect heat exchanges between said fluids. The first exchanger E1 is preferably a brazed plate exchanger comprising a plurality of plates (not visible) which extend in two dimensions, namely length and width of the exchanger, respectively in a longitudinal direction z and a lateral direction y orthogonal to z and parallel to the plates. The plates are disposed in parallel one above the other with spacing in a stacking direction x, thus forming a plurality of passages for the fluids in the method which are intended for indirect exchange of heat via the plates.

The first cooling stream 30 is introduced into a first series of passages in the first exchanger E1. A feed stream 110 is introduced into the first exchanger and circulates in a second series of passages disposed wholly or partly in alternation and/or adjacently with some or all of the passages of the first series.

The feed stream 110 is a mixture of hydrocarbons possibly from natural gas which has optionally been pretreated—for example, having undergone separation from at least one constituent from among water, carbon dioxide, sulfur compounds and methanol—before being introduced into the heat exchanger.

The feed stream 110 preferably comprises a molar fraction of at least 60% of methane, preferably at least 80%. The feed stream 110 enters for example at a pressure of between 20 and 90 bar. The feed stream is introduced into the first exchanger preferably at a temperature of between −10 and 60° C.

The feed stream 110 may be fractionated, meaning that a portion of the C2+ hydrocarbons containing at least two carbon atoms is separated from the natural gas using a device known to those skilled in the art. The collected hydrocarbons C2+ are sent into fractionating columns comprising a de-ethanizer. The light fraction collected at the top of the deethanizer may be mixed with the stream 110. The liquid fraction collected at the bottom of the deethanizer is sent to a depropanizer.

The feed stream 110 is introduced into the first exchanger E1 via a first inlet 20. The first cooling stream 30 enters the exchanger E1 via a second inlet 22 with optionally a second cooling stream 202 introduced via a third inlet 21. The inlets and outlets for the various fluids are arranged such that the overall flow of the fluids in the exchanger E1 occurs parallel to the longitudinal direction z, which is preferably vertical when the exchanger is in operation.

The first inlet 20 for the feed stream 110 is disposed at the hot end 1*a* of the exchanger and has the highest temperature of the first exchanger E1. Conversely, the cold end 1*b* of the exchanger presents the point of entry into the exchanger where a fluid is introduced with the lowest temperature of the exchanger temperatures.

The second inlet 21 for the first cooling stream 30, and optionally the third inlet 20 for the stream 202, are preferably arranged at the hot-end side 1*a* such that the streams 110, 202, 30 circulate cocurrently in the descending direction, in the direction of the cold end 2*b* sited at a low level of the exchanger.

The first cooling stream may be formed by a mixture of hydrocarbons, such as a mixture of ethane and propane, but may also contain nitrogen, methane, butane and/or pentane. The first cooling stream preferably comprises between 40 and 90% of ethane and between 10 and 60% of propane (mol %).

Note that according to one embodiment of the invention, ethane may be substituted wholly or partly by ethylene and/or propane may be substituted wholly or partly by propylene, meaning that in the above composition of the first cooling stream ethylene may be used in place of some or all of the ethane and/or propylene may be used in place of some or all of the propane. This enables an efficiency gain for the method, since the difference in evaporation temperature at constant pressure between ethylene and propylene is greater than the difference in these temperatures for ethane and propane. In this way it is possible to minimize the temperature difference between the hot fluids and the cold fluids and so to enhance the efficiency of the method.

After being introduced via the second inlet 22, the first cooling stream 30 is divided into three fractions 301, 302, 303, called partial cooling streams, which are successively withdrawn via respective outlets 11, 12, 13 of the exchanger E1. Each partial cooling stream is expanded through a respective expansion element V1, V2 and V3, so as to lower the pressure of the partial cooling streams to three different pressure levels.

By "expansion element" is meant any device, such as a valve, for example a Joule-Thomson valve, a turbine or a combination of a turbine and a valve, which is arranged on or in the fluid circuit, preferably an automatically controlled valve, and which enables the pressure of the fluid to be reduced from an initial pressure value to a desired pressure value.

The partial cooling streams are preferably expanded to pressure values which increase in the longitudinal direction z, i.e., in the direction of the hot end 1*a*.

The lowest expansion level pressure value is preferably between 1.1 and 2.5 bar. The highest expansion level pressure value is preferably between 10 and 20 bar. There may be at least one intermediate pressure level with an expansion pressure value of between 4.5 and 7.5 bar The expanded partial cooling streams are preferably at temperatures which increase in the longitudinal direction z, i.e., in the direction of the hot end 1*a*. These temperatures correspond to the temperatures of introduction at the respective inlets into the exchanger E1. The partial cooling stream expanded to the lowest pressure level preferably has a temperature of between −80 and −60° C. The partial cooling stream expanded to the highest pressure level preferably has a temperature of between −20 and 10° C. There may be at least one intermediate expansion level with a post-expansion temperature of between −50 and −25° C. The temperatures of the cooling streams evaporated at the respective outlets may be between −10 and 60° C., 20 and −45° C. and/or −20 and −75° C., respectively for the expansion levels described above.

The expansions give rise to a plurality of biphasic cooling streams, which are introduced into phase separator elements 24, 25, 26. Such elements may be any device suitable for separating a biphasic cooling stream into both a gaseous cooling stream and a liquid cooling stream.

Note that the biphasic cooling streams generally each have a gas/liquid ratio of less than 10%, preferably of between 2 and 5% (mol %), said ratio being defined as the relation between the molar flow rate of liquid phase and the molar flow rate of gaseous phase.

In the context of the invention, only the liquid phases 34, 35, 36 extracted from the biphasic cooling streams are reintroduced into the first exchanger E1 to be evaporated therein against the feed stream 110 and the first cooling stream 30. The gaseous phases 31, 32, 33 are diverted from the first exchanger E1, meaning that they are not introduced into it.

Hence the liquefaction plant is greatly simplified, it being no longer necessary to have specific introduction devices, and the problems linked to nonuniform distribution of the phases within the biphasic cooling streams are avoided. Moreover, the gaseous phases commonly exchange only sensible heat when they are flowing in the exchanger, and so the impact on the energy performance of the cycle is negligible.

In the exchanger E1, each liquid cooling stream is evaporated against the feed stream 110, which undergoes cooling or even liquefaction at least partially. The liquid cooling streams preferably flow from the cold end 1*b* of the exchanger E1 to its hot end 1*a* in the longitudinal direction z, in the ascending direction. Note that the respective pairs of inlets and outlets are preferably arranged in increasing order of expansion pressure in the direction of the hot end 1*a*. Note also that the liquid cooling streams are introduced into dedicated passages in the exchanger that are arranged in a heat exchange relation with some or all of the passages of the first series and of the second series.

A cooled hydrocarbon stream 102 is obtained at the outlet from the exchanger E1, for example at a temperature of between −55 and −75° C.

The first stream 30 as well is preferably cooled against the liquid cooling streams, which undergo evaporation.

A plurality of evaporated cooling streams exit the first exchanger via respective outlets 14, 15, 16 and then are sent to different stages of at least one pressure-increasing element K1, such as a compressor. The stream obtained from the compressor is introduced into an indirect heat exchanger such as a condenser and is condensed by heat exchange with an external cooling fluid, for example water or air, before then being returned to the first exchanger E1 via the second inlet 22.

The pressure of the first cooling stream at the outlet of the compressor may be between 25 and 50 bar. The temperature of the first cooling stream at the outlet of the compressor may be between −10 and 60° C.

Advantageously, the gaseous phases 31, 32, 33 which were diverted from the first exchanger E1 are recombined with the corresponding evaporated cooling streams exiting the first exchanger E1. This offers the advantage of lowering the temperature of the fluids introduced into the compressor and hence reducing the power needed for recompression.

Located between each phase separator element 24, 25, 26 and each respective recombination point there may be a supplementary separator element, for example a valve. In this way it is possible if needed to adjust the liquid level in the phase separator element 24, 25, 26 or, in the event of plant stoppage, to prevent cold gas streams flowing to the outside of the heat-insulated casing, also called cold box, containing the exchangers E1 and E2 and the phase separators 24, 35, 26 and 27.

According to the invention, moreover, for each of the evaporated cooling streams exiting the first exchanger E1, the temperature of the evaporated cooling stream is measured at its respective outlet 14, 15, 16.

A determination is also made of the dew point of the evaporated cooling stream. The term "dew point" denotes the temperature below which the vapor of a gaseous element condenses at the pressure under consideration. This is the temperature from which the first drop of liquid appears in the stream.

This temperature depends especially on the composition of the cooling stream and on the pressure value of the expansion level under consideration.

On the basis of this information, a determination is made of a first temperature difference corresponding to the difference between the measured temperature of the evaporated cooling stream and the dew point. A setpoint flow rate applied to the expansion element of the stage under consideration is adjusted as a function of the first difference so as to reduce the flow rate of partial cooling stream expanded when the first temperature difference is less than a first predetermined value and to increase the flow rate of partial cooling stream expanded when the first temperature difference is greater than said first predetermined value.

Accordingly, the flow rate is regulated for each expanded partial cooling stream as a function of the temperature measured at the exchanger outlet, such as to keep this outlet temperature greater than the dew point, and to do so with a safety margin corresponding to the first temperature difference.

The regulation performed according to the invention is advantageous especially if the flow rate of feed stream 110 introduced into the first exchanger E1 drops, as it allows a consequent adjustment to the flow rate of cooling stream entering the exchanger so that it is not too great and so that its evaporation is incomplete.

It is therefore ensured that the cooling stream exiting via each respective outlet of the first exchanger is indeed completely evaporated, thus preventing risks of damage to the pressure-increasing element arranged downstream of the exchanger, while controlling the flow rate so that the first difference remains low enough to maximize the performance of the exchanger.

Advantageously, the first predetermined value is strictly greater than 0° C., preferably not less than 2° C.

The first predetermined value is preferably not less than 5° C., preferably not more than 15° C., more preferably between 8 and 12° C., more particularly of the order of 10° C. These values are selected so as to permit fine regulation of the method while also allowing sufficient time to react to a sudden fluctuation in the method without any risk of sending incompletely evaporated liquid to the pressure-increasing element.

Preferably, for each of the evaporated cooling streams, the setpoint flow rate is applied via aflow rate control element, or flowmeter, coupled to the expansion element V1, V2, V3, i.e., capable of cooperating with the expansion element to allow the desired flow rate to be regulated or adjusted, said control element being governed by the first temperature difference.

Preferably, the adjustment of the setpoint flow rate according to the invention gives rise to at least one flow rate increase or reduction by of the order of 5 to 20% of the flow rate of the cooling stream under consideration, preferably between 10 and 20% (relative difference).

Note that the flow rates of cooling stream entering the exchanger after the various expansion levels may range from 5000 to 200 000 $Nm^3/h$, depending on the production capacity of the liquefaction plant.

The control steps described above are preferably iterative steps. They may be reiterated with a period of between 100 milliseconds and 1 second, preferably of between 200 and 500 milliseconds, which allows the method to be regulated as stably as possible without a disproportionately strong reaction to a short-acting stress factor.

Note that the temperature measurements may be carried out by any device or sensor, preferably a resistance probe, for example a PT100 probe, or else a thermocouple or thermistor temperature probe.

The control and/or regulation steps described in the present patent application are advantageously implemented by a digital command and control system, also referred to as a DCS (Distributed Control System), this being a control system for an industrial process that comprises a human-machine interface for supervision and a digital communications network. The DCS system comprises a plurality of modular controllers which control the subsystems or units of the overall plant, typically a set of devices comprising at least one microcontroller and each configured to provide at least: the acquisition of data from at least one temperature sensor, the control of at least one actuator connected to at least one flow rate controller element, the regulation and governing of PID control loop parameters, the transmission of data between the different devices in the system.

According to one advantageous embodiment, the setpoint control described above may take account in parallel of other information coming from the process in order to further optimise the performance.

More specifically, a measurement is also made of the temperatures at which the feed stream 110 and the first cooling stream 30 are introduced into the first exchanger E1. Use is also made of at least one of the evaporated cooling stream temperature measurements carried out at the respective outlets 14, 15, 16.

Two supplementary temperature differences are determined: a second difference corresponding to the difference between the temperature at which the feed stream 110 is introduced and the temperature of the evaporated cooling stream, and a third difference corresponding to the difference between the temperature at which the first cooling stream 30 is introduced and the exit temperature of the evaporated cooling stream.

As a function of these parameters, adjustment is made to the setpoint flow rate applied to at least one expansion element V1, V2, V3, so as to reduce the flow rate of partial cooling stream expanded via the expansion element when the second temperature difference is greater than a second predetermined value or when the third temperature difference is greater than a third predetermined value.

This enables the cooling flow rate to be optimised, i.e., to permanently maintain the sufficient flow rate needed to operate the process at its point of maximum efficiency.

The reason is that the smaller the temperature difference between heat-generating fluid and refrigerant fluid at the hot end of the exchanger, the greater the maximization of the transfer of available energy from the refrigerant fluid to the heat-generating fluid, while avoiding excessive consumption of refrigerant fluid flow rate relative to actual requirements.

Note that this second regulating mode is operated simultaneously to the first mode described above and that the first mode takes priority over the second mode in the event of any changes in flow rate contrary to those resulting from the first mode.

Advantageously, the second predetermined value and/or the third predetermined value is not greater than 10° C., preferably between 1 and 5° C., more preferably between 1 and 3° C., and advantageously of the order of 2° C. These values offer a good compromise between sizing of the exchange surface and energy to be supplied to the compression elements. Indeed, the smaller the temperature difference, the greater the exchange surface needed but the lower the circulating flow rates, so minimizing the required power supplied to the compression elements.

The second and third temperature differences are preferably measured solely on the basis of the temperature measured at the outlet closest to the hot end 1*a* of the first exchanger E1 (16 in FIG. 1). This prevents the plant becoming too complex, as this outlet is the most accessible for a temperature measurement to be performed.

Figure 2:
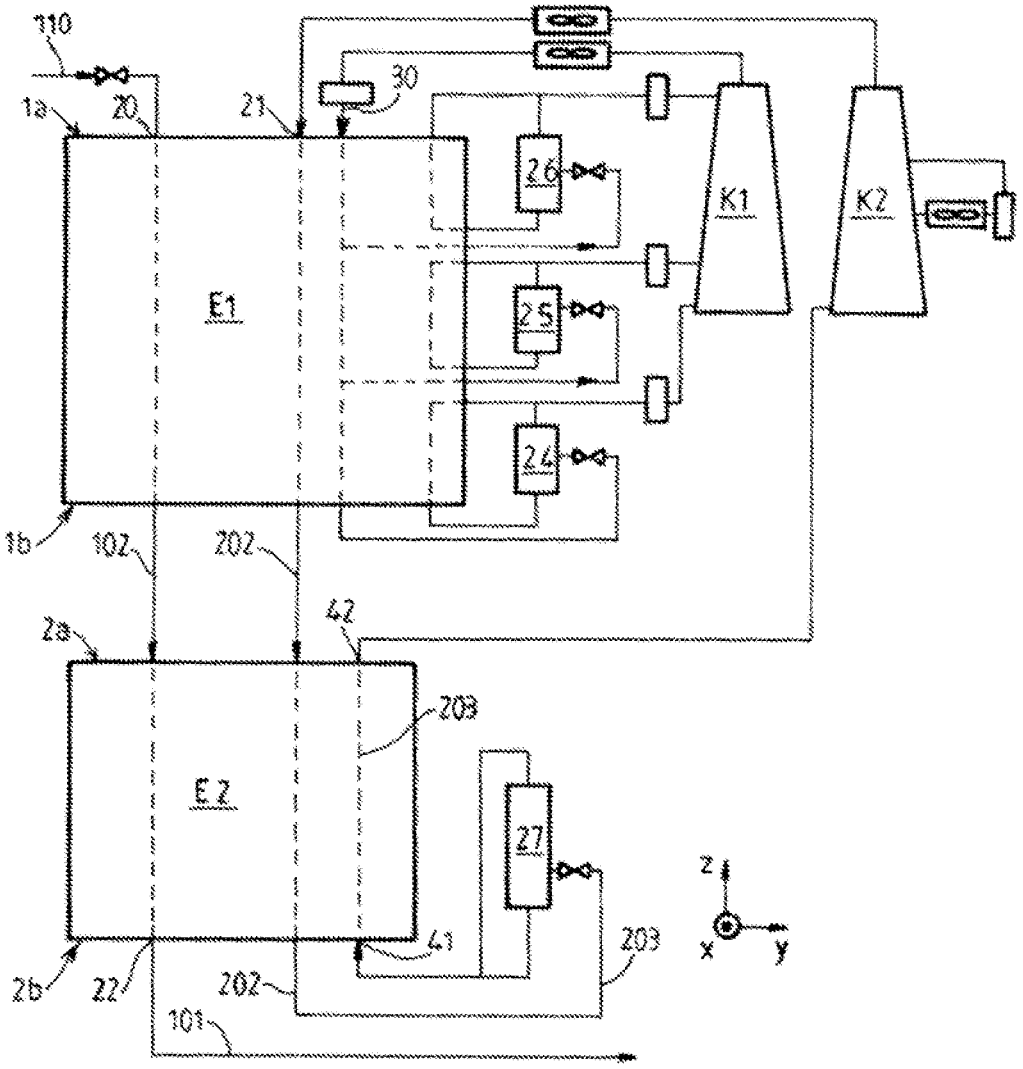
FIG. 2 schematically shows a method for liquefying a hydrocarbon stream according to another embodiment of the invention.

According to one advantageous embodiment, illustrated by FIG. 2, the method according to the invention may further comprise at least one supplementary cooling cycle for the feed stream 110, performed downstream of the cycle described above.

Note that, generally, the terms "downstream" and "upstream" refer to the flow direction of the fluid under consideration, in the present instance the stream 110.

This cycle is implemented in a second heat exchanger E2, generally termed the liquefying exchanger, downstream of the first heat exchanger E1, in that case termed the precooling exchanger.

The second exchanger E2 may also be a plate exchanger. The cooled hydrocarbon stream 102 enters the second exchanger E2 with a second cooling stream 202. The streams circulate in dedicated passages in directions parallel to the longitudinal direction z.

Advantageously, the inlets of streams 102 and 202 are sited at the hot end 2*a* of the exchanger E2, at the location of the highest temperature level in the exchanger, such that the hydrocarbon stream 102 and the cooling stream 202 flow cocurrently in the descending direction, in the direction of the cold end 2*b* sited at a lower level in the exchanger.

Preferably, the hydrocarbon stream 102 is introduced in the gaseous state the hydrocarbon stream is introduced in the gaseous or partially liquid state into the second exchanger E2 at a temperature of between −80 and −35° C. Note that the stream 102 may also be introduced in at least partially or even completely liquefied form into the second exchanger E2, at a temperature which may be between −130 to −100° C.

The cooling stream 202 is preferably introduced at a temperature of between −120 and −160° C. and exits the exchanger E2 at a lower temperature of between −140 and −170° C.

On exit from the exchanger E2, the cooling stream 202 is expanded by an expansion element, such as a turbine, a valve or a combination of a turbine and a valve, so as to form a biphasic stream. The liquid and gaseous phases may be separated beforehand in a separator 27 before being recombined and reintroduced in the liquid-gas mixture 203 state into the exchanger E2.

The second biphasic cooling stream 203 is reintroduced into the exchanger E2 via an inlet 41 sited at the cold end 2*b* such that the stream 203 flows in the ascending direction. The stream 203 is evaporated, performing countercurrent cooling of the streams 102 and 202.

The evaporated cooling stream exits at 42 from the exchanger E2, and then is compressed by a compressor K2, then cooled in an indirect heat exchanger by exchanging heat with an external cooling fluid, for example water or air.

The second cooling stream 202 is formed, for example, by a mixture of hydrocarbons and nitrogen, such as a mixture of methane, ethane and nitrogen, but may also contain propane and/or butane. The mole fraction proportions (%) of the components of the cooling stream may be:

Nitrogen: 0% to 10%;
Methane: 30% to 70%;
Ethane: 30% to 70%;
Propane: 0% to 10%

The natural gas exits the second exchanger E2 in a totally liquefied state 101 at a temperature that is preferably at least 10° C. higher than the bubble point temperature of the liquefied natural gas produced at atmospheric pressure (the bubble point temperature denotes the temperature at which the first vapor bubbles form in a liquid natural gas at a given pressure) and at a pressure that is identical to the inlet pressure of the natural gas, except for pressure losses. For example, the natural gas exits the second exchanger E2 at a temperature of between −135° C. and −170° C. and at a pressure of between 15 and 85 bar. Under these temperature and pressure conditions, the natural gas does not remain entirely liquid after expansion up to atmospheric pressure.

Of course, the invention is not limited to the particular examples described and illustrated in the present application. Other alternative forms or embodiments within the competence of a person skilled in the art may also be contemplated without departing from the scope of the invention. For example, other configurations for injecting and extracting fluids into and from the exchanger, other directions of flow of the fluids, other types of fluids, other types of exchangers, etc., may of course be contemplated, depending on the constraints stipulated by the method to be implemented.

The invention claimed is:

1. A method for liquefying a stream of hydrocarbons from a feed stream, said method comprising:

a) introducing the feed stream into a first heat exchanger,
b) introducing a first cooling stream into the first heat exchanger,
c) extracting a plurality of partial cooling streams obtained from the first cooling stream from the first heat exchanger via separate outlets,
d) introducing each partial cooling stream from step c) into a separate expansion element and expanding each partial cooling stream to produce a plurality of biphasic cooling streams at different pressures,
e) introducing each biphasic cooling stream from step d) into a separate phase separator element to produce a gaseous cooling stream which is diverted from the first exchanger and a liquid cooling stream which is introduced into the first exchanger via respective inlets,
f) evaporating each liquid cooling stream by heat exchange with at least the feed stream and the first cooling stream so as to extract a cooled hydrocarbon stream at the outlet from the first heat exchanger and to extract a plurality of evaporated cooling streams via the respective outlets of the first heat exchanger, further comprising, for each of the evaporated cooling streams from step f), the following steps:

g) measuring the temperature of the evaporated cooling stream at its respective outlet,
h) measuring the dew point of the evaporated cooling stream,
i) determining a first temperature difference corresponding to the difference between the temperature measured in step g) and the dew point measured in step h),
j) adjusting a setpoint flow rate applied to the expansion element that the respective cooling stream originates ultimately from as a partial cooling stream, as a function of the first temperature difference determined in step i) so as to reduce the flow rate of partial cooling stream expanded in step d) when the first temperature difference is less than a first predetermined value and to increase the flow rate of partial cooling stream expanded in step d) when the first temperature difference is greater than said first predetermined value.

2. The method as claimed in claim 1, wherein the first predetermined value is not less than 5° C.

3. The method as claimed in claim 1, wherein, for each of the evaporated cooling streams, the setpoint flow rate is applied via a flow rate control element coupled to the expansion element and governed by the first temperature difference determined in step i).

4. The method as claimed in claim 1, wherein, prior to step j), the flow rate of partial cooling stream has a setpoint value and, in step j), the flow rate of partial cooling stream is reduced or increased by 5 to 20% relative to the setpoint value.

5. The method as claimed in claim 1, wherein steps g) to j) are reiterated at a period of between 100 milliseconds and 1 second.

6. The method as claimed in claim 1, wherein the feed stream is introduced via a first inlet sited at a hot end of the first exchanger, said first inlet having the highest temperature of the exchanger, and at least one of the liquid cooling streams is introduced via a respective inlet sited at a cold end of the first exchanger, said respective inlet having the lowest temperature of the exchanger, the liquid cooling streams being evaporated in the first exchanger in an ascending direction and in the direction of the hot end.

7. The method as claimed in claim 1, wherein each gaseous cooling stream and each evaporated cooling stream obtained from a respective phase separator element are recombined at a recombination point and then introduced into a pressure-increasing element such as a compressor.

8. The method as claimed in claim 7, wherein each gaseous cooling stream is introduced into a supplementary separator element disposed between the recombination point and the phase separator element.

9. The method as claimed in claim 1, wherein the biphasic cooling streams produced in step d) each have a gas/liquid ratio of less than 10%, said ratio being defined as the relation between the molar flow rate of liquid phase and the molar flow rate of gaseous phase in each biphasic cooling stream.

10. The method as claimed in claim 1, wherein the first cooling stream comprises a mixture of hydrocarbons containing a plurality of constituents selected from the group consisting of methane, ethane, nitrogen, propane, butane and pentane.

11. The method as claimed in claim 10, wherein the first cooling stream comprises between 40 and 90 mol % of ethane and between 10 and 60 mol % of propane.

* * * * *